US006283803B1

(12) United States Patent
Sato et al.

(10) Patent No.: US 6,283,803 B1
(45) Date of Patent: Sep. 4, 2001

(54) ELECTRICAL CONTACT

(75) Inventors: Naotoshi Sato; Masaya Yamamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/556,820

(22) Filed: Apr. 21, 2000

(30) Foreign Application Priority Data

Apr. 27, 1999 (JP) ..... 11-119390

(51) Int. Cl.[7] ..... H01R 11/22; H01R 13/11
(52) U.S. Cl. ..... 439/852
(58) Field of Search ..... 439/852, 851, 439/850, 853

(56) References Cited

U.S. PATENT DOCUMENTS

| | | | | |
|---|---|---|---|---|
| 5,540,603 | * | 7/1996 | Fujiwara | 439/851 |
| 5,879,205 | * | 3/1999 | Egenolf et al. | 439/852 |
| 5,975,963 | * | 11/1999 | Higuchi et al. | 439/851 |
| 6,042,433 | * | 3/2000 | Chen | 439/852 |

FOREIGN PATENT DOCUMENTS

| | | | |
|---|---|---|---|
| 10-189102 | 7/1998 | (JP) | H01R/13/11 |
| 98/29924 | 7/1998 | (WO) | H01R/13/115 |

* cited by examiner

*Primary Examiner*—Brian Sircus
*Assistant Examiner*—Brian S. Webb
(74) *Attorney, Agent, or Firm*—Sughrue, Mion, Zinn, Macpeak & Seas, PLLC

(57) ABSTRACT

An electrical contact includes an electrical contact portion which has a square tubular shape, and into which a mating contact is insertable. The electrical contact portion includes a bottom wall (6), a pair of opposite side walls (7, 8) extending upright from the bottom wall (6), a top wall (9) extending from one of the opposite side walls (7) and disposed in opposed relation to the bottom wall (6), and a reinforcing wall (12) formed integrally with the other one of the opposite side walls (8) and partially covering the top wall (9). A pair of lower and upper resilient contact pieces (18, 17) are formed integrally with the top wall (9) of the electrical contact portion, and located in the electrical contact portion. The lower resilient contact piece (18) extends from the top wall (9), and the upper resilient contact piece (17) opposes to the lower resilient contact piece. Distal end portions (**18*b*, 17*b*) of the pair of lower and upper resilient contact pieces (18, 17) are extended in different directions away from each other. Holes (21, 22) for receiving the distal end portions (18*b*, 17*b*) of the pair of lower and upper resilient contact pieces (18, 17), are respectively formed through at least two of the walls (6, 9**) of the electrical contact portion.

13 Claims, 7 Drawing Sheets

ELECTRICAL CONTACT

BACKGROUND OF THE INVENTION

1. Field of the Invention

The present invention relates to an electrical contact having a resilient contact piece for electrical connection to a mating contact.

The present application is based on Japanese Patent Application No. Hei. 11-119390, which is incorporated herein by reference.

2. Description of the Related Art

A conventional electrical contact as shown in FIG. 12 is disclosed by Unexamined Japanese Patent Publication No. Hei. 10-189102.

This electrical contact 80 includes an electrical contact portion 81 for receiving a mating contact (not shown) therein, and a wire connection portion 82 for clamping a wire (not shown).

The electrical contact portion 81 has a square tubular shape. More specifically, the electrical contact portion 81 includes an interconnecting wall 85, extending from the other side wall (not shown) to one side wall 84 in contiguous relation to a lower surface of a top wall 83, and a bifurcated-resilient contact piece 86 extending downwardly from a free end of the interconnecting wall 85. The resilient contact piece 86 includes an upper resilient contact piece 87, bent downwardly from the free end of the interconnecting portion 85, a curved bent plate 88 folded back from a rear end of the upper resilient contact piece 87, and a lower resilient contact piece 89 extending forwardly from the bent plate 88.

Distal end portions 87*a* and 89*a* of the resilient contact piece 86 are curved (or bent) away from each other, thereby securing the amount of displacement of the resilient contact piece 86 at the time of insertion of the mating contact. Auxiliary walls 92 and 93 extend respectively from front ends of the top and bottom walls 83 and 90 into an insertion port 91 for the mating contact, and these auxiliary walls correct the posture of the mating contact at the time of insertion of the mating contact.

The distal end portions 87*a* and 89*a* of the resilient contact piece 86 are thus curved away from each other, but merely with construction, the distal end portions 87*a* and 89*a* are abutted respectively against the top wall 83 and the bottom wall 90 (or one of the two distal end portions is abutted against the corresponding wall), and therefore the amount of displacement of the resilient contact piece 86 (that is, the range in which the resilient contact piece can be displaced) has been inadequate. Further, the auxiliary walls and 93 are provided at the insertion port 91, but merely with this construction, an insertion opening 94 for receiving the mating contact is merely narrowed, thus failing to provide the ability to easily receive the mating contact.

SUMMARY OF THE INVENTION

With the above problems in view, it is an object of the present invention to provide an electrical contact in which at the time of insertion of a mating contact, a resilient contact piece can be displaced in a sufficient amount within an electrical contact portion, and also has the ability to easily receive the mating contact.

To achieve the above object, according to the first aspect of the present invention, there is provided an electrical contact which comprises an electrical contact portion, into which a mating contact is insertable, having a square tubular shape, the electrical contact portion including a bottom wall, a pair of opposite side walls extending upright from the bottom wall, a top wall extending from one of the opposite side walls and disposed in opposed relation to the bottom wall, and a reinforcing wall formed integrally with the other one of the opposite side walls and partially covering the top wall; and a pair of lower and upper resilient contact pieces electrically connectable to the mating contact, the pair of lower and upper resilient contact pieces being formed integrally with the top wall of the electrical contact portion, and located in the electrical contact portion, wherein the lower resilient contact piece extends from the top wall, the upper resilient contact piece opposes to the lower resilient contact piece, and distal end portions of the pair of lower and upper resilient contact pieces are extended in different directions away from each other, and wherein holes for receiving the distal end portions of the pair of lower and upper resilient contact pieces, are respectively formed through at least two of the walls of the electrical contact portion.

In the above construction, when the mating contact is inserted into the electrical contact portion, the resilient contact pieces are resiliently deformed in accordance with the insertion of the mating contact, and therefore, the respective distal end portions of the resilient contact pieces are displaced. At this time, the distal end portions of the resilient contact piece will not abut respectively against the walls disposed in the displacement directions thereof, but escape respectively into the holes respectively formed through the walls.

Further, according to the second aspect of the present invention, it is preferable that the top wall has a curved portion extending from an end portion of the top wall remote from a mating contact inserting-side, and wherein the lower resilient contact piece extends from the curved portion.

Further, according to the third aspect of the present invention, it is preferable that the curved portion serves as a vibration-absorbing plate which causes the pair of lower and upper resilient contact pieces follow the mating contact during the insertion and withdrawal of the mating contact.

Further, according to the fourth aspect of the present invention, it is preferable that the electrical contact further comprises contact points respectively formed on the pair of lower and upper resilient contact pieces to define the distal end portions of the pair of lower and upper resilient contact pieces.

Further, according to the fifth aspect of the present invention, it is preferable that the pair of lower and upper resilient contact pieces gradually approaches each other toward the distal end portions thereof, and are bent at the respective contact points so that the distal end portions of the pair of lower and upper resilient contact pieces are extended in the different directions away from each other.

Further, according to the sixth aspect of the present invention, it is preferable that the distal end portions of the pair of lower and upper resilient contact pieces are extended in the different directions away from each other so that a whole shape of the distal end portions of the pair of lower and upper resilient contact pieces is tapered toward the contact points of the pair of lower and upper resilient contact pieces.

Further, according to the seventh aspect of the present invention, it is preferable that the electrical contact further comprises a pair of inward projections respectively formed on at least two of the walls of the electrical contact portion different from the at least two walls having the holes so as to narrow an insertion opening of the electrical contact portion for receiving the mating contact. In this construction, it is preferable that the distal end portions of the pair of first and second resilient contact pieces are respectively tapered toward their extended directions from the contact points. Accordingly, the distal end portions of the resilient contact pieces are pointed, and by doing so, there can be provided the pair of inward projections projecting respectively from the walls spaced from each other in the direction intersecting the displacing direction. With this construction, the insertion opening for receiving the mating contact can be narrowed. Even when the mating contact is inserted obliquely into the electrical contact portion, it abuts against at least one of the inward projections, and can not enter the electrical contact portion in such an inclined condition.

Further, according to the eighth aspect of the present invention, it is preferable that the electrical contact further comprises excessive displacement prevention pieces formed respectively on the at least two walls having the holes, the excessive displacement prevention pieces projecting in opposed relation to the respective contact points. Accordingly, when the mating contact is inserted, the contact points of the resilient contact pieces abut respectively against the excessive displacement prevention pieces, thereby preventing the resilient contact piece from being further displaced.

Incidentally, the contact points are brought into electrical contact with the mating contact when the mating contact is inserted into the electrical contact portion. Also, an interconnecting plate is formed between the lower resilient contact piece and the upper resilient contact piece, and that is formed integrally with the pair of lower and upper resilient contact pieces.

DETAILED DESCRIPTION OF THE PREFERRED EMBODIMENT

A preferred embodiment of the present invention will now be described with reference to the drawings.

FIGS. 1 to 11 show one preferred embodiment of an electrical contact of the present invention.

Figure 1:
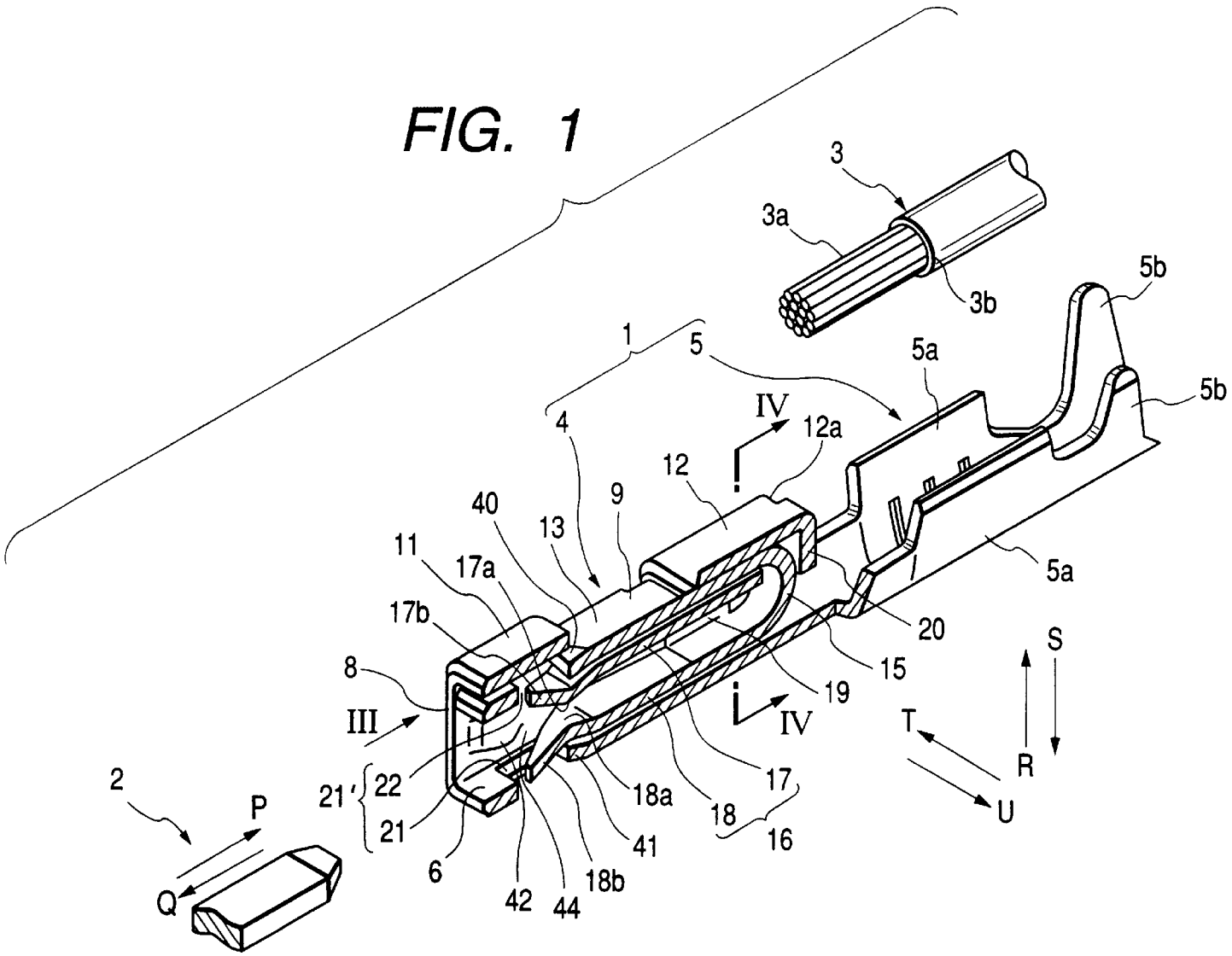
FIG. 1 is a perspective view showing the whole of one preferred embodiment of an electrical contact of the present invention.

As shown in FIG. 1, this electrical contact 1 includes an electrical contact portion 4, into which a mating contact 2 can be inserted to be electrically connected thereto, and a wire connection portion 5 to which a wire 3 can be connected. In this embodiment, the electrical contact 1 is of the female type while the mating contact 2 is of the male type. Hereafter, the term "mating contact-inserting direction" means the direction (direction P) of insertion of the mating contact 2, and the term "the opposite direction" means the direction (direction Q) of withdrawal (disengagement) of the mating contact 2. "Displacing direction" means a direction R and a direction S.

Figure 2:
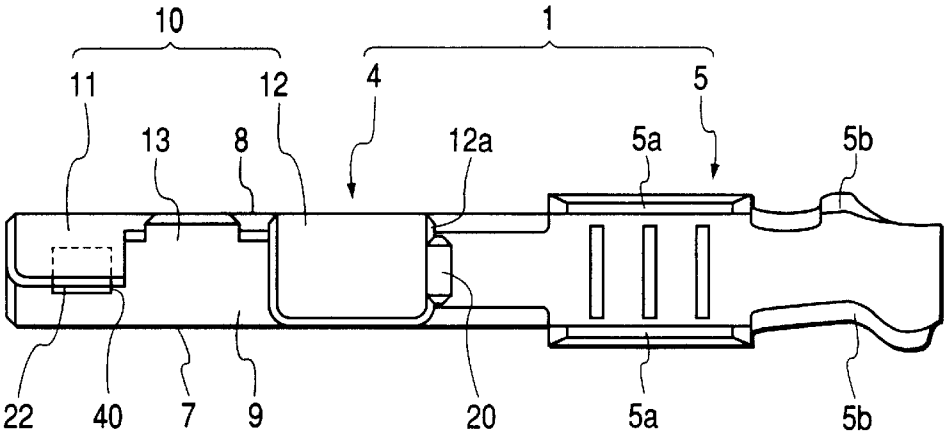
FIG. 2 is a top plan view of the electrical contact of FIG. 1.
Figure 4:
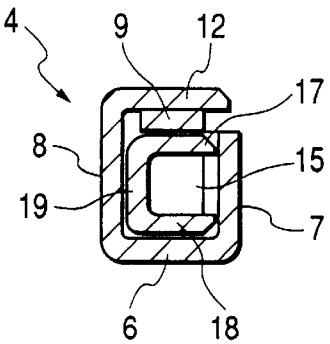
FIG. 4 is a cross-sectional view taken along the line IV—IV of FIG. 1.
Figure 3:
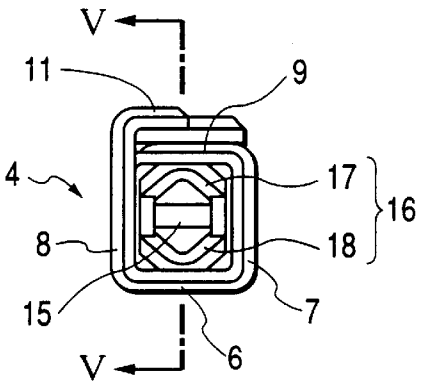
FIG. 3 is a view as seen in a direction of arrow 'III' of FIG. 1.

As shown in FIGS. 1 and 2, the electrical contact portion 4 is formed into a square tubular shape.

More specifically, the electrical contact portion 4 includes a bottom wall 6, a pair of side walls 7 and 8, extending upright respectively from opposite side edges of the bottom wall 6, a top wall 9, extending from one side wall 7 and disposed in opposed relation to the bottom wall 6, and a reinforcing wall 10 formed integrally with the other side wall 8 and partially covering the top wall 9.

A retaining wall 13 extends from that side edge of the top wall 9, disposed adjacent to the other side wall 8, at a lengthwise-central portion thereof. A retaining groove (not shown) for the retaining wall 13 is formed in an upper end of the other side wall 8 at a lengthwise-central portion thereof. The retaining wall 13 is retainingly engaged in the retaining groove, thereby positioning the top wall 9 relative to the other side wall 8.

As shown in FIGS. 1 to 4, the reinforcing wall 10 includes a front reinforcing wall 11, extending from a front end portion of the other side wall 8, and a rear reinforcing wall 12 formed integrally with a rear end portion of the other side wall 8. The front reinforcing wall 11 partially covers a front end portion of the top wall 9, and the rear reinforcing wall 12 completely covers a rear end portion of the top wall 9. The reinforcing wall 10 covers the top wall 9, thereby preventing the top wall 9 from being lifted or raised. There can be used an arrangement in which two retaining walls 13 are formed integrally with the opposite end portions of the top wall 9, respectively, and a reinforcing wall 10 extends from a central portion of the other side wall 8.

As shown in FIGS. 1 to 5, a vibration-absorbing plate 15 of a curved shape is formed integrally with the top wall 9 at the rear end thereof remote from the mating contact inserting-side. The vibration-absorbing plate 15 has resiliency, and can be resiliently deformed and moved in accordance with the insertion and withdrawal (disengagement) of the mating contact 2. Since the vibration-absorbing plate 15 can follow the mating contact 2, the resilient force (spring pressure) of the vibration-absorbing plate 15 is set to a force smaller (lower) than the force of insertion and withdrawal (disengagement) of the mating contact 2.

Figure 5:
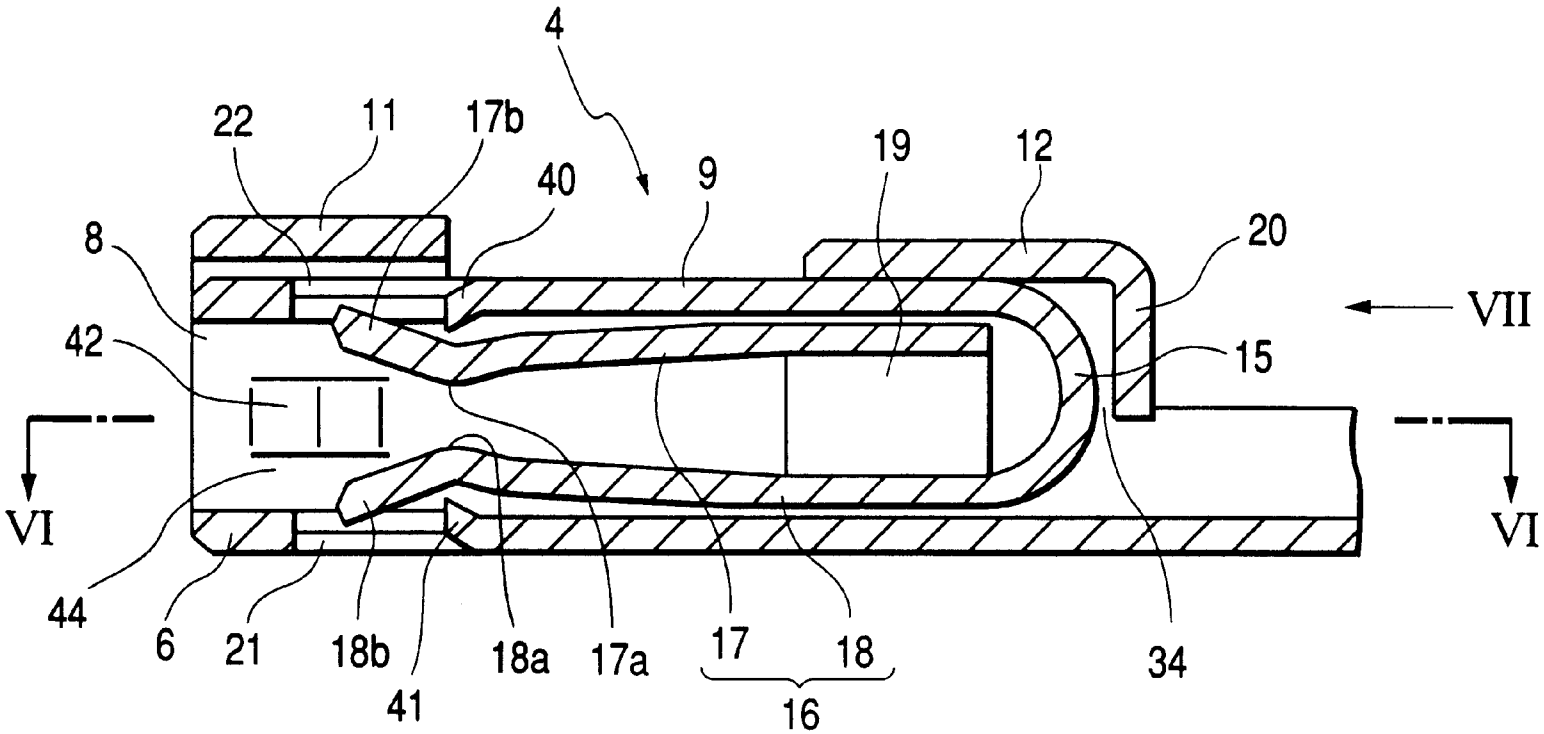
FIG. 5 is a cross-sectional view taken along the line V—V of FIG. 3.
Figure 6:
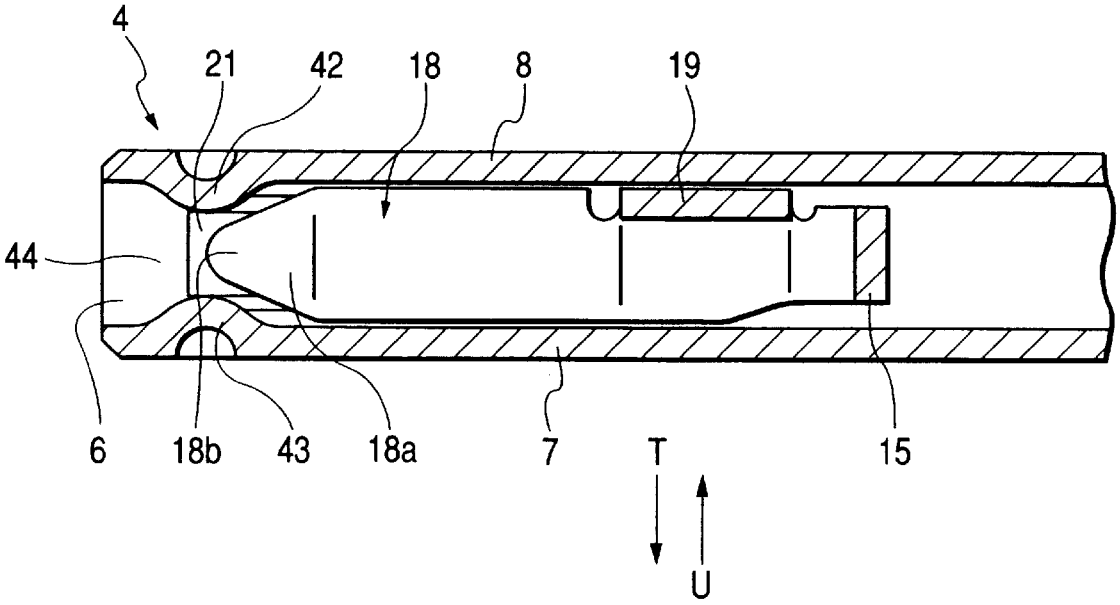
FIG. 6 is a cross-sectional view taken along the line VI—VI of FIG. 5.

As shown in FIGS. 1, 5 and 6, a bifurcated-resilient contact piece 16 extends from the vibration-absorbing plate 15, and this resilient contact piece 16 can be displaced upward and downward toward the bottom wall 6 and/or the top wall 9. The resilient contact piece 16 includes a lower resilient contact piece 18, connected to the vibration-absorbing plate 15, an upper resilient contact piece 17, disposed in opposed relation to the lower resilient contact piece 18, and an interconnecting plate 19 interconnecting the upper and lower resilient contact pieces 17 and 18.

The upper resilient contact piece 17 is opposed to the top wall 9, and the lower resilient contact piece 18 is opposed to the bottom wall 6. In a natural condition of the resilient contact piece 16 (that is, in a non-inserted condition of the mating contact 2), the upper and lower resilient contact pieces 17 and 18 gradually approach each other from their proximal end portions, disposed adjacent to the vibration-absorbing plate 15, and then are turned (or bent) away from each other. More specifically, those portions of the upper and lower resilient contact pieces 17 and 18, which are closest to each other, are contact points 17*a* and 18*a*, respectively, and the two resilient contact pieces 17 and 18 are turned (or bent) away from each other from the contact points 17*a* and 18*a* toward their distal end portions 17*b* and 18*b*. More specifically, the upper resilient contact piece 17 is bent gradually from its proximal end portion (disposed adjacent to the vibration-absorbing plate 15) toward the bottom wall 6, and then is turned (or bent) from the contact point 17*a* toward the top wall 9. Similarly, the lower resilient contact piece 18 is bent gradually from its proximal end portion (disposed adjacent to the vibration-absorbing plate 15) toward the top wall 9, and then is turned (or bent) from the contact point 18*a* toward the bottom wall 6. The distal end portions 17*b* and 18*b* of the upper and lower resilient contact pieces 17 and 18 are tapering from the contact points 17*a* and 18*a*, respectively.

As shown in FIGS. 1, 5 and 6, the interconnecting plate 19 is generally parallel to the other side wall 8, and the upper and lower resilient contact pieces 17 and 18 are interconnected at their side edges by this interconnecting plate 19.

Figure 7:
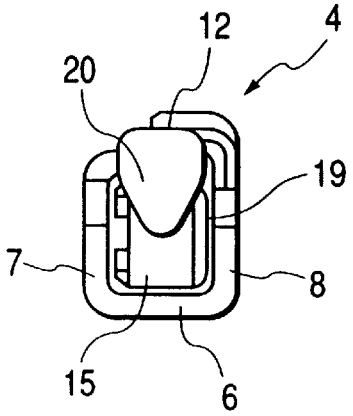
FIG. 7 is a view as seen in a direction of arrow VII of FIG. 5.

As shown in FIGS. 1, 5 and 7, a stopper wall 20 extends downwardly from a rear end 12*a* of the rear reinforcing wall 12 toward the bottom wall 6. The angle between the rear reinforcing wall 12 and the stopper wall 20 is substantially 90 degrees.

As shown in FIGS. 1 and 5, a lower hole 21 and an upper hole 22 (which will be collectively referred to merely as "hole 21') are formed respectively through the front end potions (the mating contact inserting-side) of the bottom and top walls 6 and 9, each of these holes 21 and 22 having a rectangular shape. The hole 21' can have other shape than a rectangular shape. As a result of formation of the hole 21', the distal end portions 17*b* and 18*b* of the upper and lower resilient pieces 17 and 18 can escape respectively into the upper and lower holes 22 and 21 when the mating contact 2 is inserted. Therefore, the sufficient amount of displacement (i.e., degree of displacement) of the distal end portions 17*b* and 18*b* can be secured. Thus, the sufficient displacement amount can be secured, and therefore the resilient contact piece 16 has the ability to easily receive the mating contact.

Figure 8:
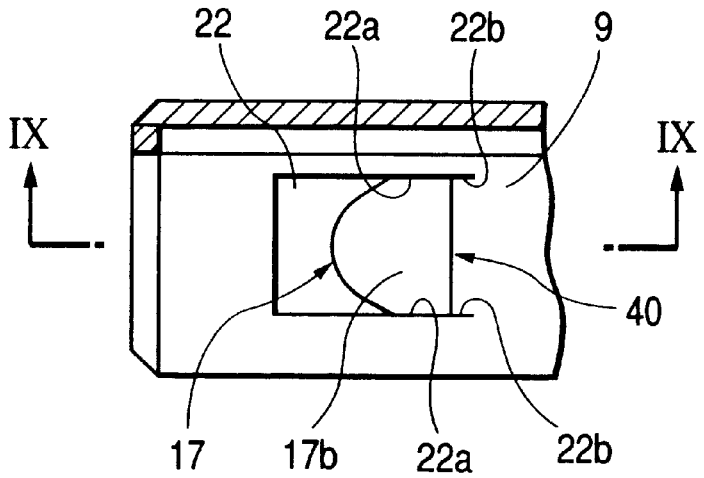
FIG. 8 is a top plan view showing an upper hole in FIG. 1.
Figure 9:
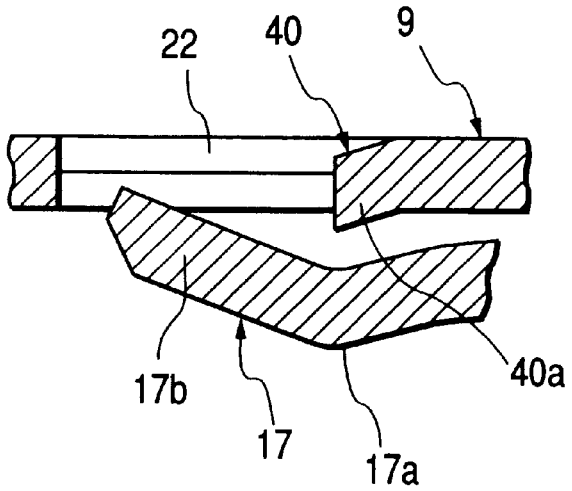
FIG. 9 is a cross-sectional view taken along the line IX—IX of FIG. 8.

As shown in FIGS. 5, 8 and 9, parallel notches 22*b* are formed in the top wall 9, and extend rearwardly from opposite side edges 22*a* of the upper hole 22, respectively, and that portion of the top wall 9, lying between the two notches 22*b*, is bent into the upper hole 22 to form an upper excessive displacement prevention piece 40. Namely, the upper excessive displacement prevention piece 40 is formed by stamping the relevant portion of the top wall 9. A free end 40*a* of the upper excessive displacement prevention piece 40 is disposed above the contact point 17*a* of the upper resilient contact piece 17, that is, generally in vertical registry with the contact point 17*a*. Therefore, the upper resilient contact piece 17, when displaced upwardly, engages the upper excessive displacement prevention piece 40, thereby preventing the excessive displacement of the upper resilient contact piece 17. Similarly, a lower excessive displacement prevention piece 41 is provided in the lower hole 21. Thus, the upper and lower excessive displacement prevention pieces 40 and 41 are disposed in the direction of displacement of the resilient contact piece 16, and therefore the excessive displacement of the resilient contact piece 16 can be positively prevented.

As shown in FIGS. 1 and 6, inward projections 42 and 43 are formed (by pressing) respectively on the front end portions of the opposite side walls 8 and 7, and project inwardly. The distal end portions 17*b* and 18*b* of the resilient contact piece 16 are disposed between the pair of inward projections 42 and 43. Thus, the inward projections 42 and 43 are disposed in a direction (direction T and direction U) perpendicular to (intersecting) the direction of displacement of the resilient contact piece 16, and each of the distal end portions 17*b* and 18*b* of the resilient contact piece 16 is tapering. With this construction, an insertion opening 44 for receiving the mating contact 2 can be narrowed. Thus, the insertion opening 44 is narrowed, that is, the pair of the inward projections 42 and 43 are formed, and therefore the movement of the mating contact 2 can be suppressed.

In the production of the electrical contacts 1, by blanking (stamping) an electrically-conductive sheet material (not shown), a plurality of electrical contact-like flat sheets (not shown) are formed continuously on an interconnecting strip (not shown), and these electrical contact-like flat sheets are pressed, and then the interconnecting strip is cut and removed.

Referring back to FIG. 1, the wire connection portion 5 includes a pair of conductor clamping piece portions 5*a* and 5*a* for clamping a conductor 3*a* of the wire 3, and a pair of sheath clamping piece portions 5*b* and 5*b* for clamping an insulating sheath 3*b* of the wire 3.

Next, the operation for inserting the mating contact 2 into the electrical contact 1 as shown in FIG. 1 will be described. The operation for withdrawing (disengaging) the mating contact 2 from the electrical contact 1 is almost similar to this inserting operation, and therefore explanation thereof will be omitted. Actually, a plurality of mating contacts 2 are connected to a plurality of electrical contacts 1, respectively. However, in this embodiment, explanation will be made of the case where one electrical contact 1 and one mating contact 2 are connected together.

Figure 10:
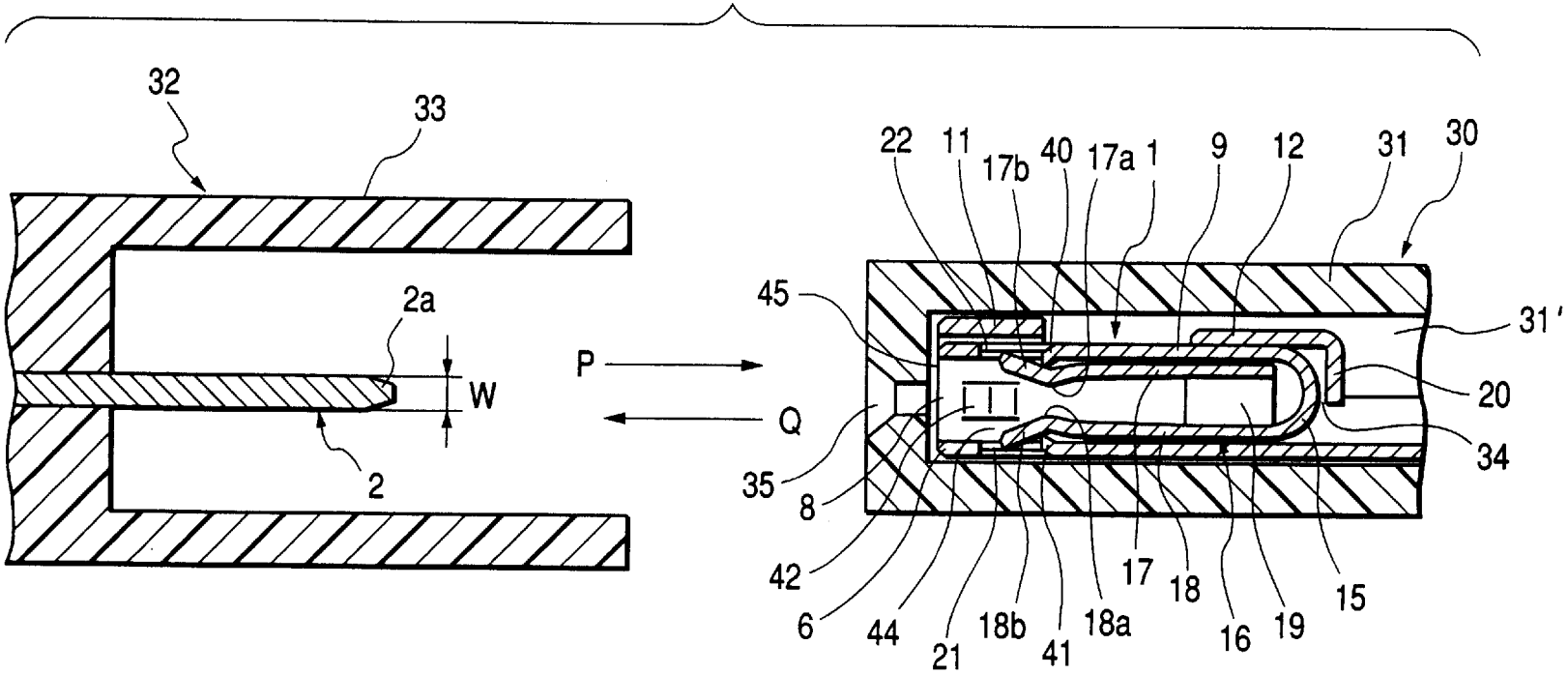
FIG. 10 is a cross-sectional view showing a male connector, formed by inserting the electrical contact of FIG. 1 into a male connector housing, and a female connector formed by inserting a mating contact into a female connector housing.

As shown in FIG. 10, the electrical contact 1 is inserted into a receiving chamber 31' in a male connector housing 31 to provide a male connector 30. Similarly, the mating contact 2 is inserted into a receiving chamber (not shown) in a female connector housing 33 to provide a female connector 33. In this condition, a gap 34 is formed between the vibration-absorbing plate 15 and the stopper wall 20 of the electrical contact 1. The resilient contact piece 16 is in its natural condition.

When the male connector 30 is inserted into the female connector 32 (or the female connector 32 is fitted on the male connector 30), the mating contact 2 passes through a contact insertion port 35 in the male connector 30, and is inserted into the electrical contact portion 4 through an introducing port 45 in the electrical contact 1. A distal end portion 2*a* of the mating contact 2 is inserted between the upper and lower resilient contact pieces 17 and 18 through the insertion opening 44 (which is narrower than that of the conventional construction) while its posture is corrected by the inward projections 42 and 43.

In accordance with this inserting operation, the upper resilient contact piece 17 is resiliently deformed upwardly (toward the top wall 9) whereas the lower resilient contact piece 18 is resiliently deformed downwardly (toward the bottom wall 6). Namely, the upper and lower resilient contact pieces 17 and 18 are resiliently deformed (displaced) until the distance between the contact points 17*a* and 18*a* becomes equal to the sheet thickness W of the mating contact 2. At this time, the distal end portion 17*b* of the upper resilient contact piece 17 enters the upper hole 22 whereas the distal end portion 18*b* of the lower resilient contact piece 18 enters the lower hole 21. Therefore, the upper and lower resilient contact pieces 17 and 18 can be displaced in a sufficient amount to receive the mating contact 2 therebetween. And besides, the contact points 17*a* and 18*a* of the resilient contact piece 16 are brought into engagement with the upper and lower excessive displacement prevention pieces 40 and 41, respectively, thereby limiting the displacement amount, and therefore the excessive displacement of the resilient contact piece 16 is prevented.

Figure 11:
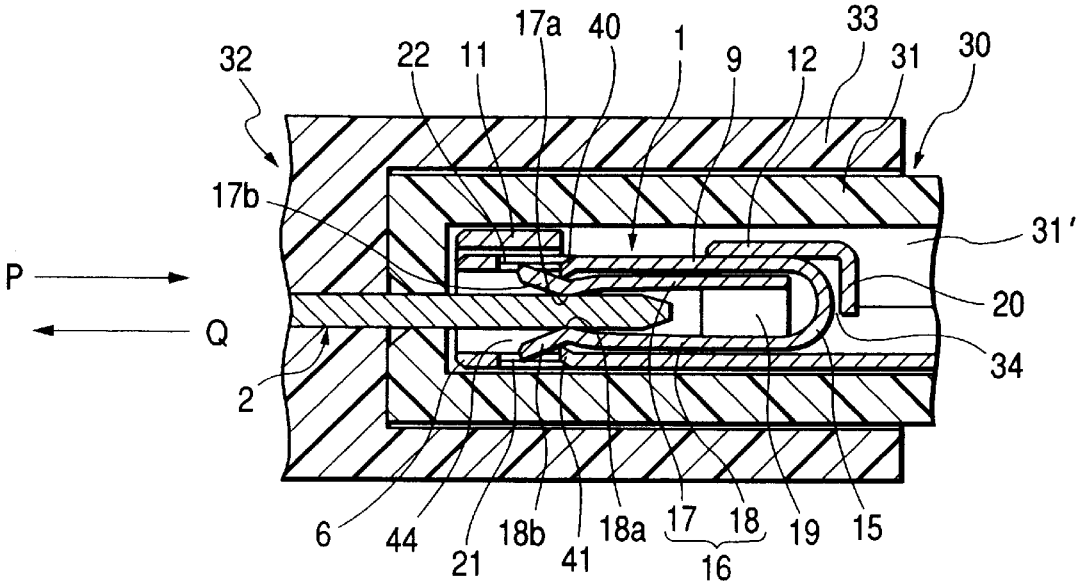
FIG. 11 is a cross-sectional view showing the male connector and the female connector of FIG. 10 in a mutually-fitted condition.
Figure 12:
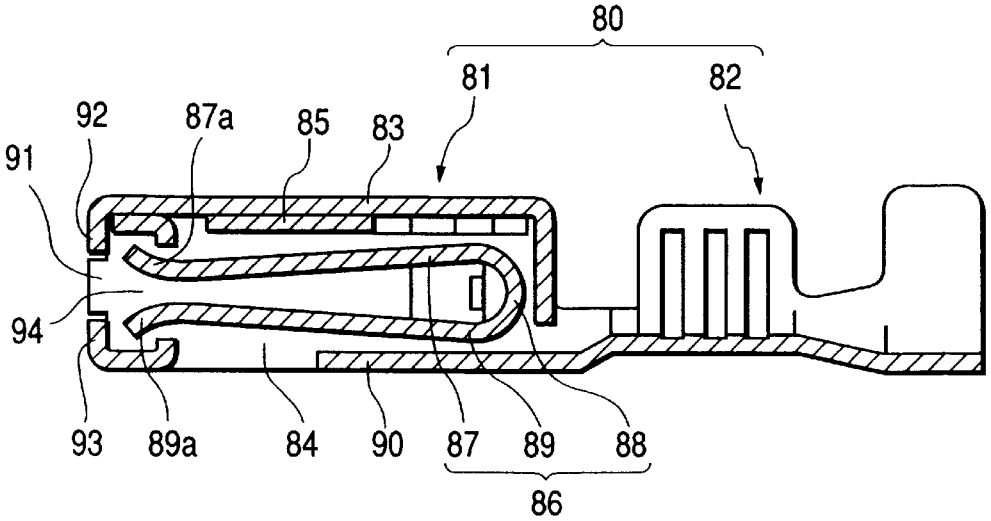
FIG. 12 PRIOR ART
FIG. 12 is a cross-sectional view of a conventional construction.

When the mating contact 2 is inserted, the resilient contact piece 16 is resiliently deformed as shown in FIG. 11, and also the resiliently-deformed resilient contact piece 16 and the vibration-absorbing plate 15 follow the mating contact 2 to move in the mating contact-inserting direction (direction P). Because of this following movement, the vibration-absorbing plate 15 is moved until it is brought into abutting engagement with the stopper wall 20. The vibration-absorbing plate 15 thus abuts against the stopper wall 20, and in this abutted condition, the mating contact 2 is further inserted in the resilient contact piece 16. Therefore, the excessive displacement of the vibration-absorbing plate 15 during the insertion of the mating contact 2 is prevented. Therefore, the mating contact 2 can be brought into stable electrical contact with the electrical contact 1. Except this, the vibration-absorbing plate 15 will not abut against the stopper wall 20, and therefore the resilient contact piece 16 will not be excessively deformed. After this fitting connection is effected, the vibration-absorbing plate 15 is kept resiliently deformed.

As described above, in the present invention, the holes are formed respectively in those walls of the electrical contact portion, disposed in the direction of displacement of the resilient contact piece, and therefore during the insertion of the mating contact, the resilient contact piece can be displaced until the distal end portions of the resilient contact piece become received in the holes, respectively. Therefore, as compared with the conventional construction, the sufficient amount of displacement of the resilient contact piece can be secured. Namely, the resilient contact piece has the ability to easily receive the mating contact. Therefore, the mating contact can be positively connected to the resilient contact piece.

And besides, since the sufficient amount of displacement of the resilient contact piece can be secured, the electrical contact portion and hence the electrical contact itself can be formed into a small size.

In the present invention, the pair of inward projections are formed respectively on those walls of the electrical contact portion spaced from each other in the direction intersecting the direction of displacement of the resilient contact piece. Therefore, as compared with the conventional construction, the movement of the mating contact in a direction parallel to the intersecting direction can be suppressed. Therefore, the electrical contact of the resilient contact piece with the mating contact can be enhanced.

That portion of the resilient contact piece, extending from the contact points to the distal end thereof, is tapering, and there are provided the inward projections. Therefore, the insertion opening for receiving the mating contact can be narrowed or made smaller. Therefore, the posture of the mating contact, inserted obliquely into the electrical contact portion, can be corrected by the inward projections and the narrow insertion opening. Therefore, damage to the mating contact and the electrical contact portion can be prevented, and besides the possibility of incomplete electrical connection between the mating contact and the electrical contact portion can be eliminated.

The excessive displacement prevention pieces are formed respectively on those walls, respectively having the holes, and project in opposed relation to the contact points, respectively. Therefore, even when the contact points of the resilient contact piece are excessively displaced during the insertion of the mating contact, the excessive displacement prevention pieces limit the excessive displacement of the contact points. Therefore, the excessive displacement of the resilient contact piece can be prevented.

What is claimed is:

1. An electrical contact, comprising:

an electrical contact portion, into which a mating contact is insertable, having a square tubular shape, the electrical contact portion including a bottom wall, a pair of opposite side walls extending upright from the bottom wall, a top wall extending from one of the opposite side walls and disposed in opposed relation to the bottom wall, and a reinforcing wall fonned integrally with the other one of the opposite side walls and partially covering the top wall; and a pair of first and second resilient contact pieces electrically connectable to the mating contact, the pair of first and second resilient contact pieces being formed integrally with the top wall of the electrical contact portion, and located in the electrical contact portion, wherein the first resilient contact piece extends from the top wall, the second resilient contact piece extends from the first resilient contact piece and opposes the first resilient contact piece with the first resilient contact piece being below the second resilient contact piece, and distal end portions of the pair of first and second resilient contact pieces are extended in different directions away from each other, and wherein holes for receiving the distal end portions of the pair of first and second resilient contact pieces, are respectively formed through at least two of the walls of the electrical contact portion.

2. The electrical contact of claim 1, wherein the top wall has a curved portion extending from an end portion of the top wall remote from a mating contact inserting-side, and wherein the first resilient contact piece extends from the curved portion.

3. The electrical contact of claim 2, wherein the curved portion serves as a vibration-absorbing plate which causes the pair of first and second resilient contact pieces follow the mating contact during the insertion and withdrawal of the mating contact.

4. The electrical contact of claim 1, further comprising contact points respectively formed on the pair of first and second resilient contact pieces to define the distal end portions of the pair of first and second resilient contact pieces.

5. The electrical contact of claim 4, wherein the pair of first and second resilient contact pieces gradually approaches each other toward the distal end portions thereof, and are bent at the respective contact points so that the distal end portions of the pair of first and second resilient contact pieces are extended in the different directions away from each other.

6. The electrical contact of claim 4, wherein the distal end portions of the pair of first and second resilient contact pieces are extended in the different directions away from each other so that a whole shape of the distal end portions of the pair of first and second resilient contact pieces is tapered toward the contact points of the pair of first and second resilient contact pieces.

7. The electrical contact of claim 6, further comprising a pair of inward projections respectively formed on at least two of the walls of the electrical contact portion different from the at least two walls having the holes so as to narrow an insertion opening of the electrical contact portion for receiving the mating contact.

8. The electrical contact of claim 1, further comprising a pair of inward projections respectively formed on at least two of the walls of the electrical contact portion different from the at least two walls having the holes so as to narrow an insertion opening of the electrical contact portion for receiving the mating contact.

9. The electrical contact of claim 4, further comprising excessive displacement prevention pieces formed respectively on the at least two walls having the holes, the excessive displacement prevention pieces projecting in opposed relation to the respective contact points.

10. The electrical contact of claim 4, wherein the contact points are brought into electrical contact with the mating contact when the mating contact is inserted into the electrical contact portion.

11. The electrical contact of claim 1, further comprising an interconnecting plate interconnecting the first resilient contact piece to the second resilient contact piece, the interconnecting plate being formed integrally with the pair of first and second resilient contact pieces.

12. The electrical contact of claim 1, wherein the distal end portions of the pair of first and second resilient contact pieces are respectively tapered toward their extended directions.

13. The electrical contact of claim 4, wherein the distal end portions of the pair of first and second resilient contact pieces are respectively tapered toward their extended directions from the contact points.

* * * * *